US005178377A

United States Patent [19]

Harrington et al.

[11] Patent Number: 5,178,377

[45] Date of Patent: Jan. 12, 1993

[54] ADHESION BREAKER FOR SHEET STACKS

[75] Inventors: John A. Harrington, Maplewood; Dennis J. Kluy, Stillwater, both of Minn.

[73] Assignee: Minnesota Mining and Manufacturing Company, St. Paul, Minn.

[21] Appl. No.: 691,569

[22] Filed: Apr. 25, 1991

[51] Int. Cl.[5] ..... B65H 5/08

[52] U.S. Cl. ..... 271/11; 271/24; 271/104; 271/106

[58] Field of Search ..... 271/10, 11, 18.1, 18.2, 271/19, 20, 42, 104, 105, 106

[56] References Cited

U.S. PATENT DOCUMENTS

| | | | |
|---|---|---|---|
| 2,159,456 | 5/1939 | Spiess | 271/106 |
| 3,861,668 | 1/1975 | Wood | 271/106 X |
| 4,509,736 | 4/1985 | Stahl et al. | 271/11 |
| 4,690,394 | 9/1987 | Maul et al. | 271/104 X |
| 5,029,039 | 6/1991 | Kuzuya et al. | 271/107 X |

FOREIGN PATENT DOCUMENTS

| | | | |
|---|---|---|---|
| 0324594 | 7/1989 | European Pat. Off. | 271/11 |
| 724246 | 8/1942 | Fed. Rep. of Germany | 271/106 |
| 255719 | 2/1949 | France | 271/106 |
| 1107804 | 8/1955 | France | 271/104 |
| 1235339 | 5/1960 | France | 271/104 |
| 0036837 | 3/1983 | Japan | 271/11 |
| 0071435 | 4/1985 | Japan | 271/11 |
| 0204534 | 10/1985 | Japan | 271/11 |
| 0013523 | 1/1990 | Japan | 271/104 |
| 530850 | 9/1938 | United Kingdom | 271/11 |

*Primary Examiner*—H. Grant Skaggs
*Assistant Examiner*—Carol Lynn Druzbick
*Attorney, Agent, or Firm*—Gary L. Griswold; Walter N. Kirn; Charles D. Levin

[57] ABSTRACT

An apparatus transports sheets of material and breaks the adhesion between first and second sheets when sheets are fed from a stack one at a time. The apparatus includes a gripper which is mounted on a gripper arm and grips the first sheet. The arm repeatedly and cyclically moves the leading edge of the first sheet to be fed while the first sheet is held by the gripper. The arm moves the leading edge of the first sheet both horizontally and vertically. The vertical cyclical motion causes air pockets to travel between the first and second sheets and the horizontal cyclical motion translates the first sheet relative to the second sheet to break the adhesion.

18 Claims, 5 Drawing Sheets

ADHESION BREAKER FOR SHEET STACKS

TECHNICAL FIELD

The present invention relates to a method and apparatus for feeding sheets of material. More particularly, the present invention relates to a method and apparatus for feeding sheets of material which prevents adhesion between the sheets.

BACKGROUND OF THE INVENTION

Electrophotographic printers, such as digital proofing and other printing machines produce single color or multicolored prints of an original document. A photoconductor film secured to a carrier member is first charged to a uniform potential to sensitize its imaging surface. The charged surface of the photoconductor film is exposed to an image of the original document, and records an electrostatic latent image corresponding to the informational areas contained within the image of the original document. The latent image is developed with liquid toners or inks. This imaging process may be repeated for each process color, with the images sequentially recorded on the photoconductor film. Typically, magenta, cyan, yellow, and black inks are the four standard colors, and additional special colors also may be used. The developed image is transferred from the photoconductor film to a print medium. Heat and pressure permanently transfer the image to the print medium to complete the process.

These apparatus, like other printers and copiers, require sheets of material, such as paper, to be fed individually from a stack in a tray to a downline location. Many different systems are used to grip and transport the first sheet from the tray to the downline location. Typically, these systems grip the sheets using vacuum grippers mounted on a bar and pivot from the tray to a downline location. However, none of these gripping and transporting systems have an integrated method, as part of the transport system, which prevents more than one sheet at a time from being fed to the downline location. Known systems require external devices to accomplish adhesion breaking. Such methods can include projecting air jets at the edge of the stack to separate the sheets, or using a relatively rough surface, such as a fixed coil spring, to scrape the edges of the sheets to separate the sheets. There is a need for a simple and inexpensive internal and integral method of transporting the sheets and breaking the adhesion between the first two sheets in a tray to prevent transporting more than one sheet at a time.

SUMMARY OF THE INVENTION

The system is an apparatus and method for feeding sheets of material one at a time from a stack in a first location to a second location. While the sheets are being fed and transported, the apparatus breaks the adhesion between the first and second sheets to prevent the transportation of more than one sheet at a time. The apparatus includes a gripper which is mounted on an arm and grips the first sheet from its side opposite the second sheet. The arm repeatedly and cyclically moves the leading edge of the first sheet to be fed while the the first sheet is held by the gripper and is transported between the first and second locations. The cyclical movement has components moving the leading edge from the first location toward the second location and components moving the leading edge from the second location toward the first location. Additionally, the cyclical movement moves the leading edge in a nonlinear motion having horizontal and vertical components.

The vertical and horizontal cyclic motion causes air pockets to become trapped and travel longitudinally between the first and second sheets. The vertical motion traps the air and the horizontal motion transports the air. The horizontal cyclic motion also translates the first sheet relative to the second sheet. These combined motions break the adhesion between the first and second sheets.

In one embodiment, the apparatus uses a four bar system to transport the sheets and break adhesion. The four bar system includes two bars which pivot around fixed points. The free ends of the bars are connected to each other through a link. The gripper bar extends from the link to a point below the lower surface of the link.

In another embodiment, the gripper bar is connected to and is mounted toward the circumference of a rotating disk. The gripper bar pivots relative to the disk. The disk is mounted over a cam which has a three-sided edge which engages and directs the movement of the gripper bar. As the disk cyclically rotates back and forth around its center, the gripper bar changes position due to its changing engagement with the edge of the cam.

DETAILED DESCRIPTION OF PREFERRED EMBODIMENTS

Figure 1:
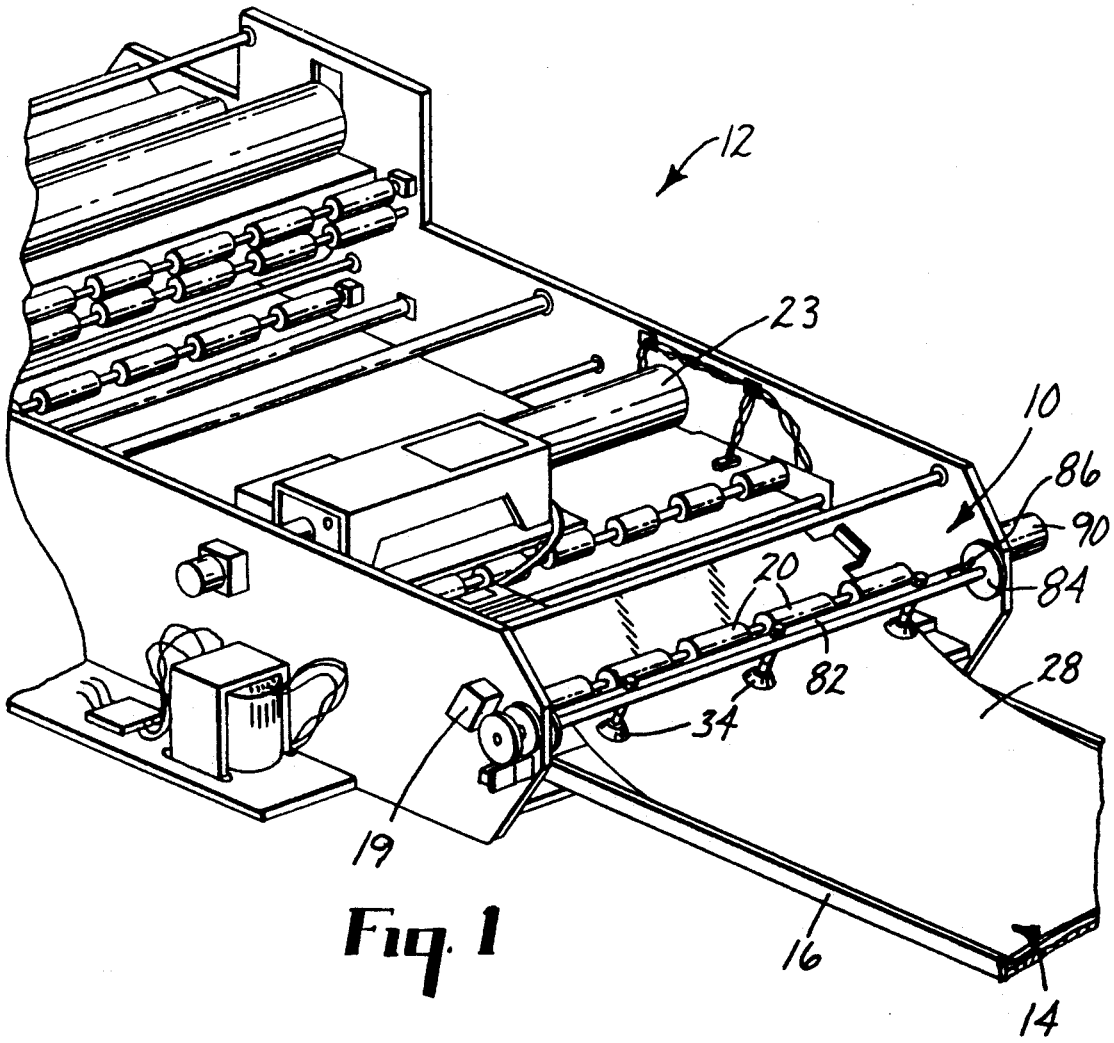
FIG. 1 is a perspective view of a transport and adhesion breaking system of the present invention, shown as part of a printer with the cover of the printer removed.

The transport and adhesion breaking system 10 is used when sheets of material are to be fed one at a time from a stack in a first location to a second location. The adhesion breaking system breaks the electrostatic adhesion as well as the surface or friction adhesion due to the intimate contact between first and second sheets. In the illustrated embodiments, and as best shown in FIG. 1, the transport and adhesion breaking system 10 is used with a printer 12. The stack of sheets 14 is placed in a sheet tray 16 at the first location 18 and is delivered to feed rollers 20 at the second location 22. The feed rollers 20 deliver the sheets 14 to a printing station 23.

In the illustrated embodiments, the transport and adhesion breaking system 10 includes a plurality of vacuum grippers 24 which are mounted on a gripper arm 26. The gripper arm 26 is one way of synchronizing the motion of the grippers 24 where more than one gripper 24 is used. Any other method also may be used. The gripper 24 grips the first sheet 28 from its side opposite the second sheet 30. The first sheet 28 can be held by the gripper 24 adjacent its leading edge 32, the edge which first enters the feed rollers 20 at the second location 22. As shown in the figures, each gripper 24 includes a cup 34 which is connected to a source of vacuum (not shown). As the gripper 24 approaches a first sheet 28 of the sheet stack 14 in the sheet tray 16, the vacuum source is activated and the sheet 28 is held on the gripper 24. The gripper arm 26 then moves the sheet 28 downline to the feed rollers 20 at the second location 22, and the vacuum source is deactivated to release the sheet 28 at the proper time. Activation and deactivation of the vacuum source can be achieved by any known methods. Alternatively, the gripper 24 can use suction, adhesive, or any other known method to hold the first sheet 28.

The motion of the gripper arm 26 from the sheet tray 16 to the feed rollers 20 is a nonlinear motion in which the gripper arm 26 moves the leading edge 32 of the first sheet 28 with both horizontal and vertical components. This nonlinear motion can be curved or can be made of angled linear segments. For the purposes of this invention, this motion will be described as arced. During this arced movement, the direction is reversed repeatedly and cyclically by a motor 36. Thus, the arced path is made up of a series of small overlapping segments created by the gripper 24 oscillating to move the leading edge 32 of the first sheet 28 alternatively toward and away from the feed rollers 20. The cyclical movement has components moving the leading edge 32 from the first location 18 toward the second location 22 and components moving the leading edge 32 from the second location 22 toward the first location 18. Both the component moving the leading edge 32 toward the second location 22 and the component moving the leading edge 32 toward the first location 18 include horizontal and vertical components. In this motion, the leading edge 32 moves toward the feed rollers 20 a first predetermined distance and then moves away from the feed rollers 20 a second predetermined distance less than the first predetermined distance.

The vertical and horizontal cyclic motions combine to cause air pockets to be trapped and travel longitudinally between the first and second sheets 28, 30 along the length of the two sheets. The vertical motion traps the air and the horizontal motion transports the air. Additionally, the horizontal cyclic motion translates the first sheet 28 relative to the second sheet 30. This breaks the adhesion between the first and second sheets 28, 30. Where the sheets 14 are flexible material, both the vertical air pocket-creating motion and the horizontal sheet-translating motion can be used to break the adhesion. In alternative embodiments, when the sheets 14 are rigid rather than flexible, the vertical motion would not create air pockets. However, the cyclic horizontal motion still would relatively translate the sheets 14 to break the adhesion.

Figure 2:
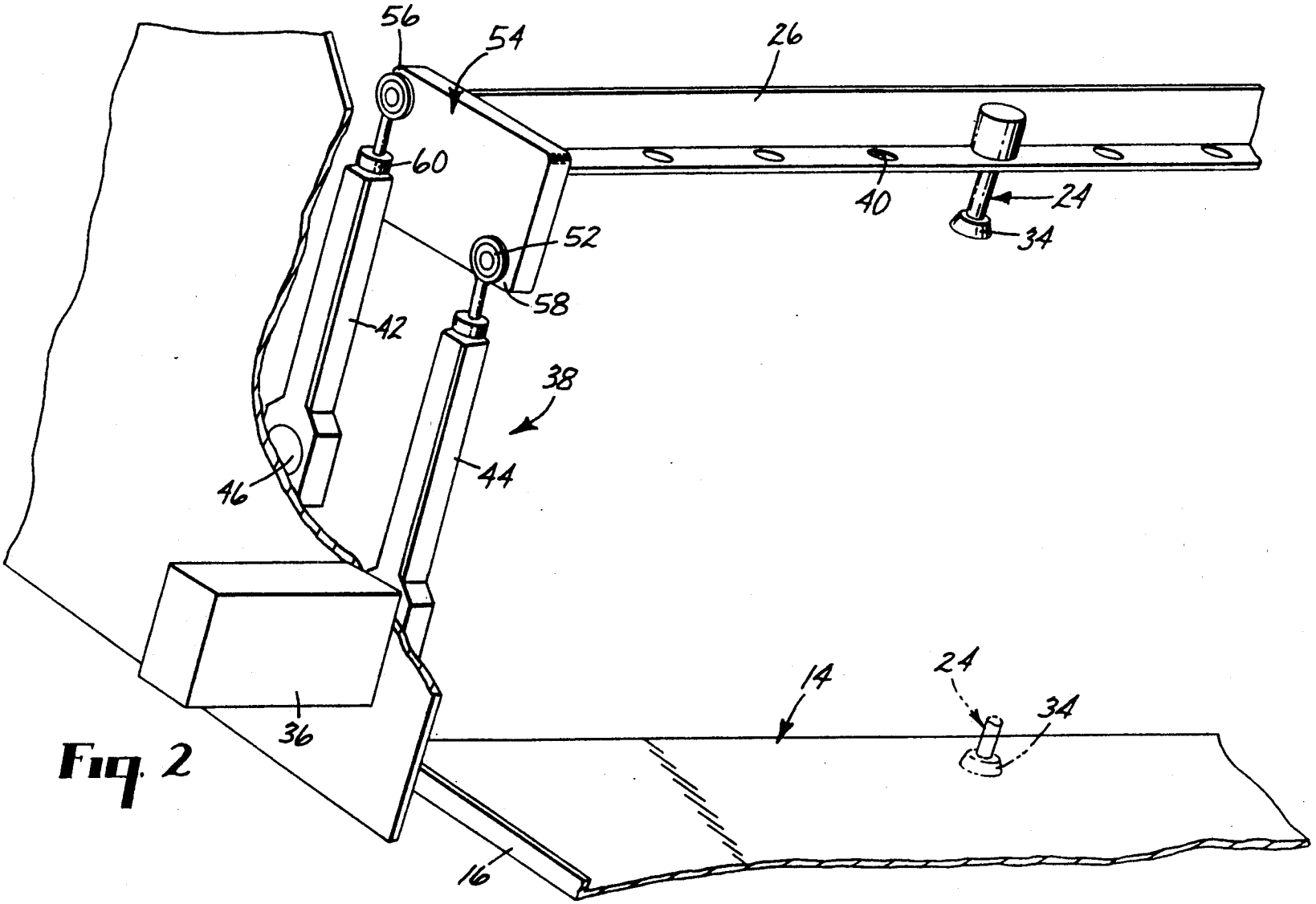
FIG. 2 is a perspective view of a transport and adhesion breaking system according to another embodiment of the present invention.
Figure 3:
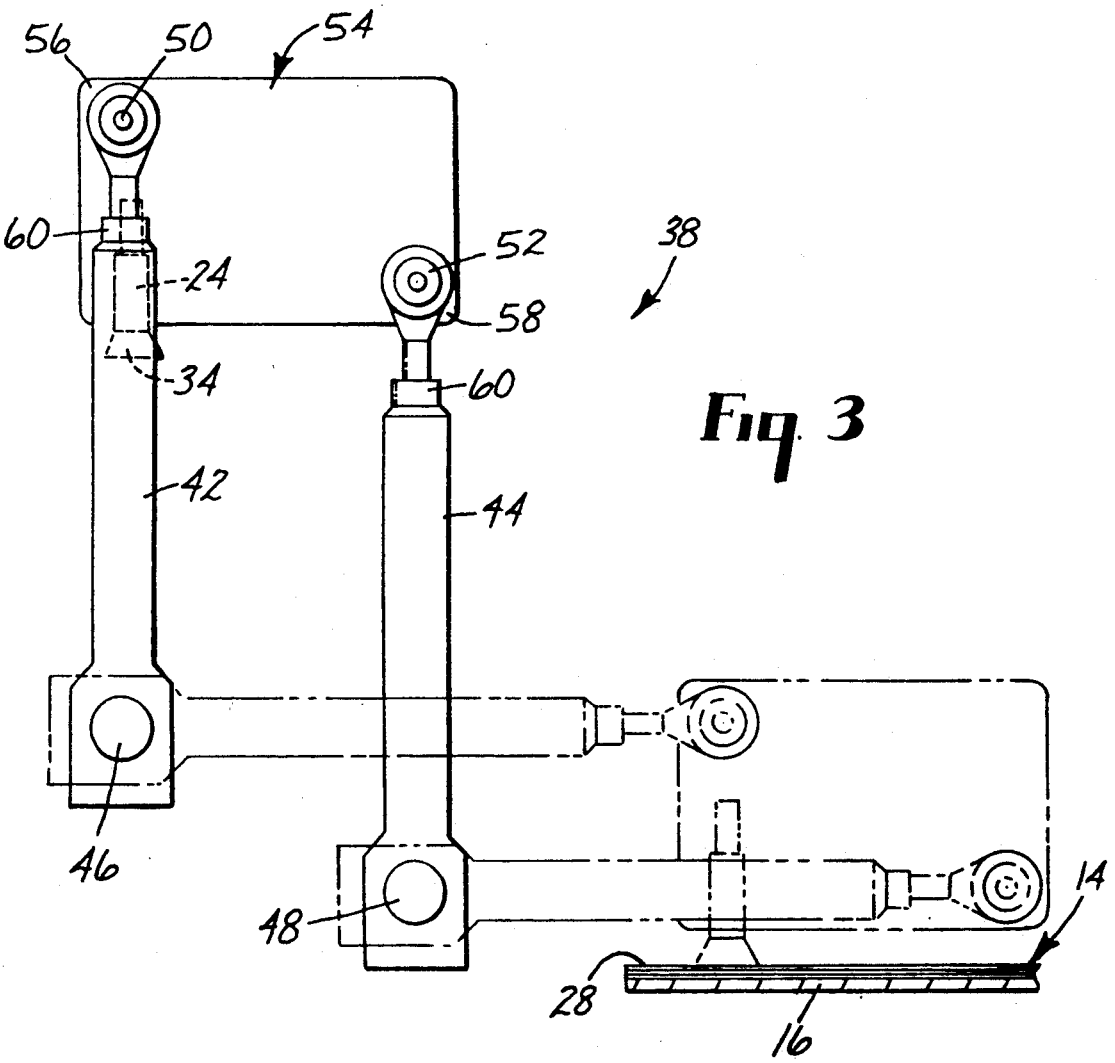
FIG. 3 is a side view of the transport and adhesion breaking system of FIG. 2.

In the preferred embodiment, the grippers 24 are mounted on the gripper bar 26 which extends from a four bar system 38, as shown in FIGS. 2 and 3. The gripper bar 26 can receive numerous grippers 24 in any of many locations, depending on the gripping needs. The grippers 24 are mounted in openings 40 in the gripper bar 26 and extend toward the sheet stack 14.

The four bar system 38 includes two pivoting bars 42, 44 which are connected in parallel at respective fixed points 46, 48. The bars 42, 44 have equal length and can pivot around their fixed points 46, 48 while remaining parallel to each other. The respective free ends 50, 52 of the bars 42, 44 are connected to each other through a rectangular link 54, at diagonally opposite corners 56, 58 of the link 54. As illustrated, the link 54 is oriented to maintain one of its sides parallel to the sheets 14 in the sheet tray 16 regardless of the orientation of the pivoting bars 42, 44, as shown in FIG. 3. The gripper bar 26 is mounted on the surface of the link 54 opposite the connection with the bars 42, 44. The grippers 24 extend from linkages 60 for a length which permits the grippers 24 to extend below the lower surface of the link 54. These surfaces remain substantially horizontal and parallel to the sheets 14 in the sheet tray 16 as the grippers 24 transport the first sheet 28 from the first location 18 to the second location 22.

The motor 36 operates the four bar system 38 together and in synchronism with the rest of the printer 12. The motor 36 pivots the system 38, and therefore the grippers 24, between the position shown in broken line in FIG. 3 and the position shown in solid line in FIG. 3, with numerous intermediate positions such as those shown in FIG. 4. In moving from the broken line position to the solid line position in FIG. 3, the grippers 24 necessarily move in both the horizontal and vertical directions as described below.

Additional external devices can be used to help separate the sheets. Air jets can project air at the edge of the stack to separate the sheets 14. Scrapers, such as fixed coil springs, can scrape the edges of the sheets 14. While these devices can supplement the system 10, they are not required elements of the system 10.

Figure 4:
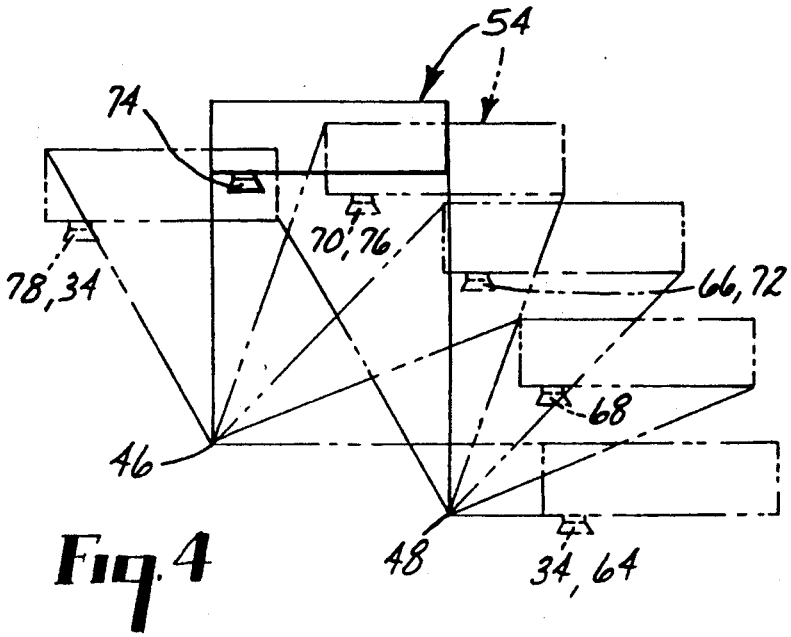
FIG. 4 is a schematic view of the transport and adhesion breaking system of FIG. 2 showing the various positions during adhesion breaking.
Figure 5:
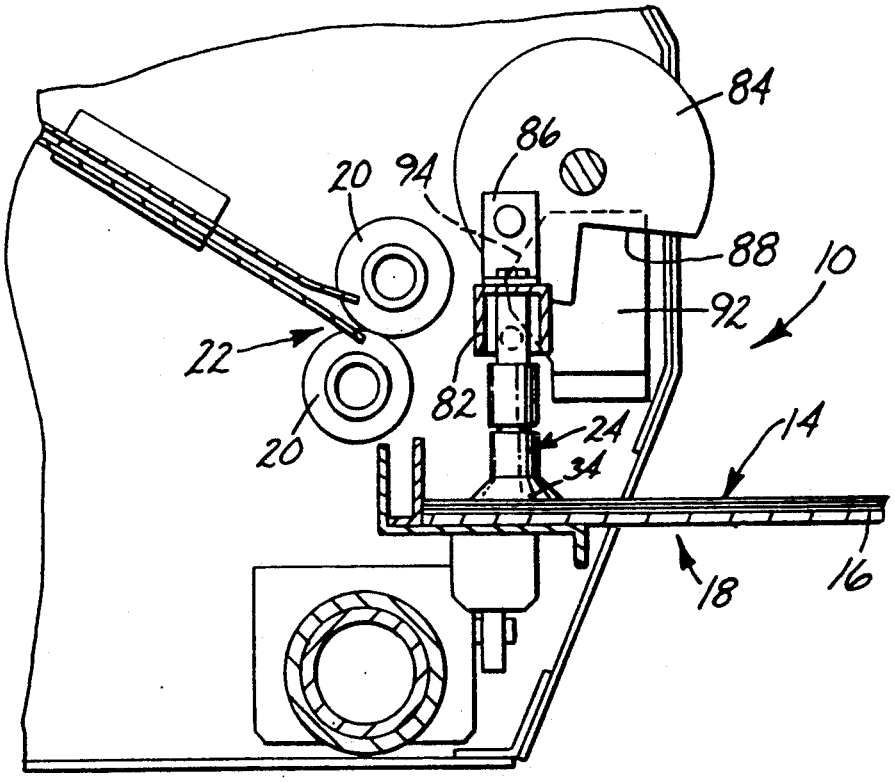
FIG. 5 is a side view of the transport and adhesion breaking system of FIG. 1 with the gripper contacting the first sheet in the first position.
Figure 7:
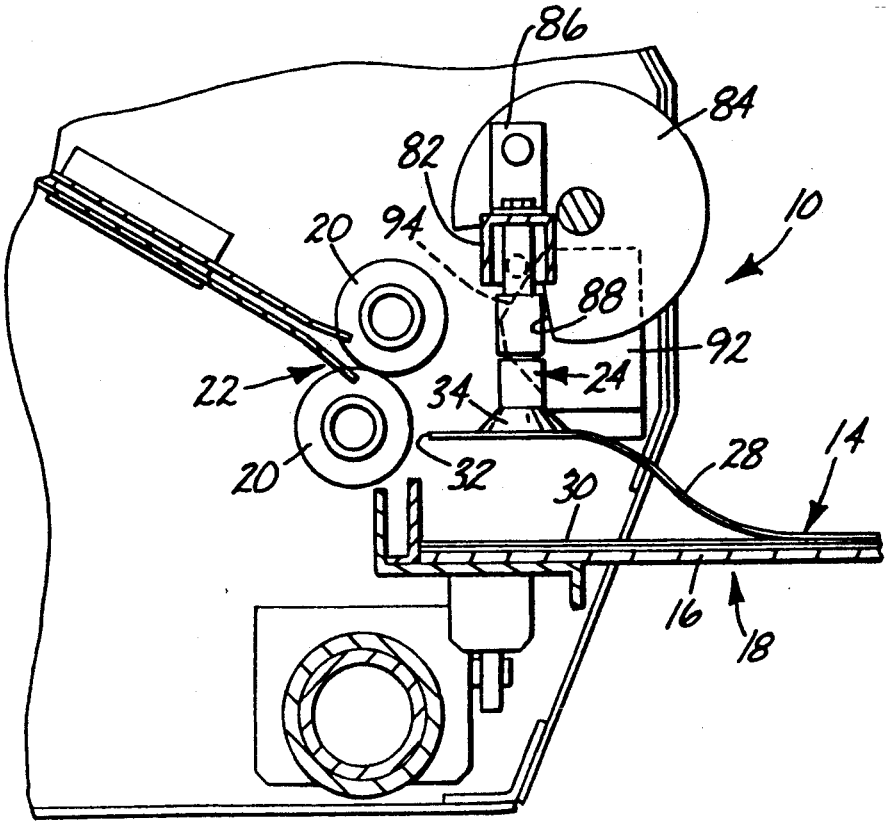
FIG. 7 is a side view of the transport and adhesion breaking system of FIG. 1 with the gripper in the seventh position.
Figure 6:
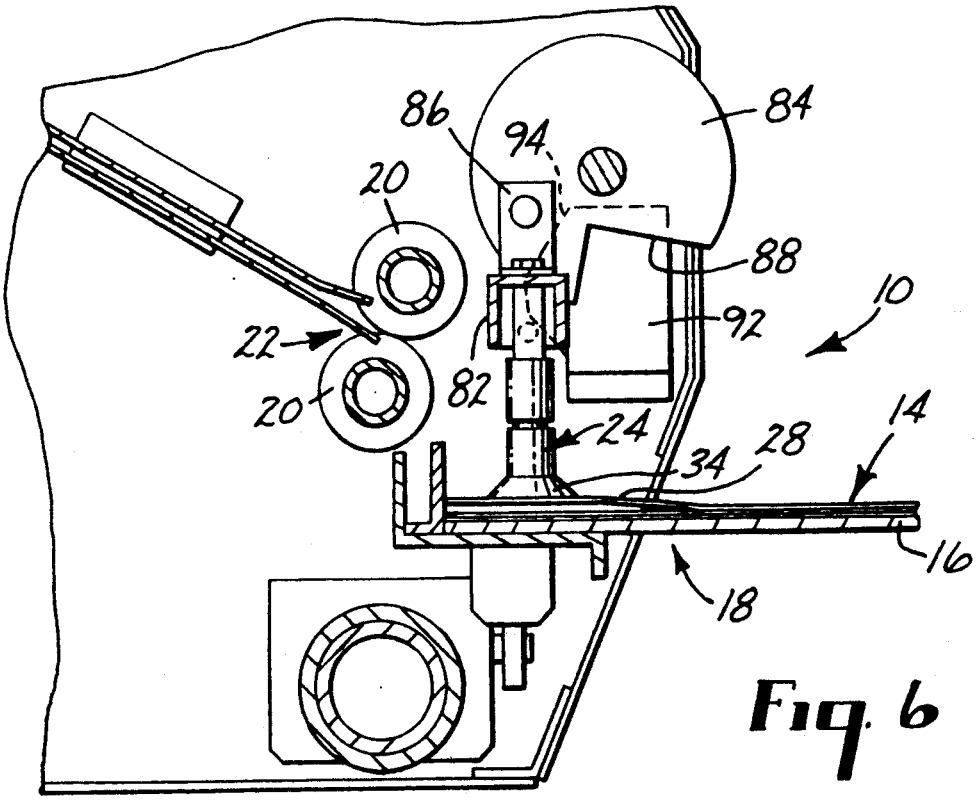
FIG. 6 is a side view of the transport and adhesion breaking system of FIG. 1 with the gripper in the third position.
Figure 8:
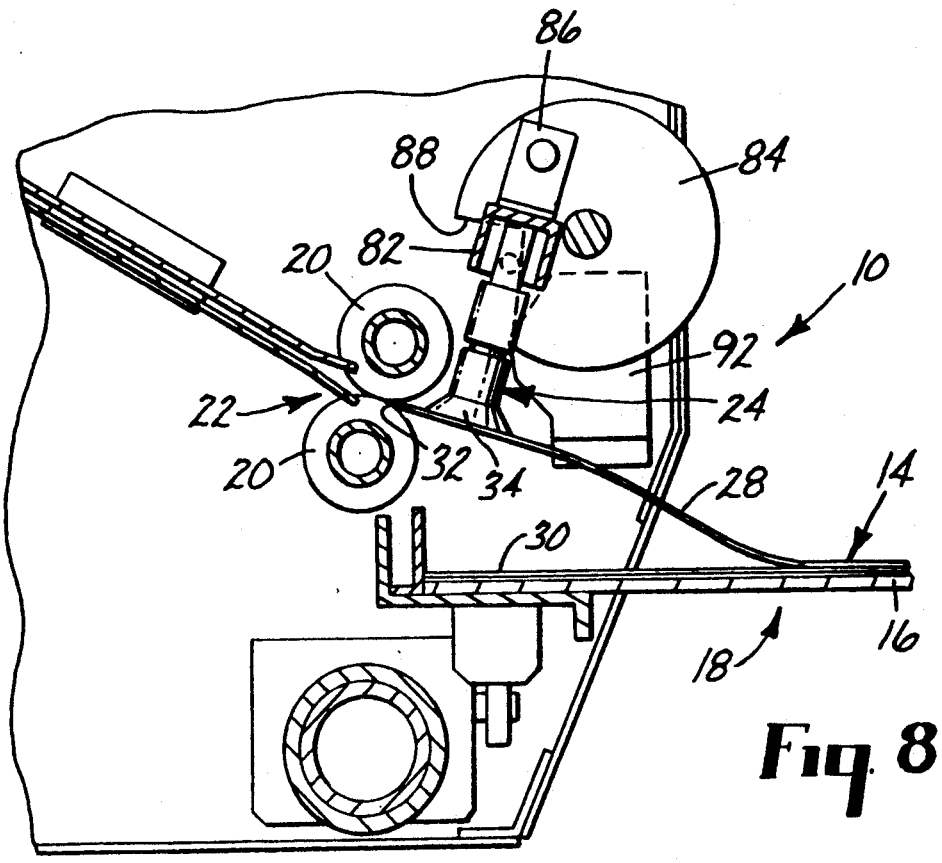
FIG. 8 is a side view of the transport and adhesion breaking system of FIG. 1 with the gripper in the eighth position.

Referring to FIG. 4, the sequence of operation is as follows. First, the grippers 24 are lowered to grip the first sheet 28 adjacent its leading edge 32, as shown in broken line in FIGS. 2 and 3. This is the first position 64 shown in FIG. 4. Upon reaching the first position 64, the cyclic oscillating motion begins. From the first position 64, the grippers 24 move to a second position 66. The second position 66 is displaced from the first position 64 in both the vertical and horizontal directions. From the second position 66 the grippers 24 reverse direction and move back toward the first position 64 and to a third position 68 located between the second position 66 and the first position 64. The third position 68 is displaced from the second position 66 in both the vertical and horizontal directions. From the third position 68 the grippers 24 again reverse direction and move past the second position 66 to a fourth position 70, once again displacing in both the vertical and horizontal directions. This continues with the grippers 24 moving from the fourth 70 to the fifth 72, to the sixth 74, to the seventh 76, and to the eighth 78 positions, each time reversing direction and displacing in both the vertical and horizontal directions. The eighth position 78 corresponds to the second location 22 at the feed rollers 20.

As shown in FIG. 4, the second 66 and fifth 72 positions are in substantially the same location. Similarly, the fourth 70 and seventh 76 positions are substantially the same. The precise locations of the first through eighth positions 64–78 can vary and need not be precisely located as long as cyclic motion is achieved. As described, three complete cycles of gripper motion are used to separate the first and second sheets 28, 30. This has been found to be sufficient for electrophotographic printers such as digital proofing machines. More or fewer cycles can be used with other systems. Also, the speed of the gripper cycling as well as the amplitudes of the cycles can be varied as desired.

In another embodiment, the grippers 24 are mounted on a gripper bar 82 which is connected to a rotating disk 84 on each side as shown in FIGS. 1, and 5–8. The gripper bar 82 is mounted off-center toward the circumference of the disk 84. An L-shaped bracket 86 connects the gripper bar 82 to the disk 84 and permits the gripper bar 82 to pivot relative to the disk 84. The disk 84 has a pie-shaped cutout portion 88 approximately one fourth the size of the disk 84. The disk 84 rotates around its center, powered by a motor 90.

The disk 84 is mounted over a cam 92 which has a three-sided edge 94 which engages and directs the movement of the gripper bar 82. As the disk 84 cyclically rotates back and forth around its center, the gripper bar 82 changes position due to its changing engagement with the edge 94 of the cam 92. After three cycles of gripper motion, the disk 84 rotates further than any of the previous rotations to cause the cutout portion 88 of the disk 84 to engage the gripper bar 82. The disk 84 then directs the gripper bar 82 and the grippers 24 to deliver the first sheet 28 to the feed rollers 20. The sequence of operation used to separate sheets 14 and transport the first sheet 28 to the feed rollers 20 of this system is substantially the same as that for the four bar system 38 of FIGS. 2–4. In this system, the movement of the grippers 24 from the seventh position 76 to the eighth position 78 is more pronounced, and is caused by the cutout portion 88 engaging the gripper bar 82.

The transport and adhesion breaking system 10 can be used with paper feeders such as with copying and printing machines, film feeders, or any other apparatus from which sheets of material 14 are fed. The transport and adhesion breaking system 10 breaks adhesion due both to surface or friction adhesion and electrostatic adhesion, both of which affect most materials. As the transport and adhesion breaking system 10 uses simple motions, it is inexpensive to design and manufacture.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention.

We claim:

1. An apparatus for transporting sheets of material one at a time from a stack in a first location to a second location and for breaking the adhesion between the first and second sheets on the stack to prevent the transportation of more than one sheet at a time, wherein each sheet has a leading edge, the apparatus comprising:

means for gripping the first sheet on the stack from its side opposite the second sheet;

means for transporting the first sheet from the first location to the second location; and means for repeatedly and cyclically moving the leading edge of the first sheet while the transporting means moves the first sheet, wherein the cyclical movement has at least two components moving the leading edge from the first location toward the second location separated by at least one component moving the leading edge from the second location toward the first location.

2. The apparatus of claim 1 wherein the moving means comprises means for causing air pockets to travel between the first and second sheets to break the adhesion while maintaining the leading edge of the first sheet substantially parallel to the sheet stack.

3. The apparatus of claim 2 wherein the means for causing air pockets to travel between the first and second sheets to break the adhesion comprises moving the leading edge of the first sheet in a nonlinear motion having both vertical and horizontal components, wherein the vertical component of the nonlinear motion traps the air and the horizontal component of the nonlinear motion transports the air.

4. The apparatus of claim 1 wherein the moving means comprises means for translating the first sheet in the plane of the first sheet and relative to the second sheet to break the adhesion.

5. The apparatus of claim 4 wherein the means for translating the first sheet in the plane of the first sheet and relative to the second sheet to break the adhesion comprises moving the leading edge of the first sheet in a nonlinear motion having both vertical and horizontal components, wherein the horizontal component of the nonlinear motion translates the first sheet.

6. The apparatus of claim 1 wherein the transporting means comprises a gripper bar and wherein the moving means comprises means for moving the gripper bar repeatedly and cyclically.

7. The apparatus of claim 1 wherein the transporting means and the moving means comprise a single integral system.

8. The apparatus of claim 7 wherein the transporting means and the moving means comprise:

a rotating disk;

a gripper bar which extends from the rotating disk at a location off-center toward the circumference of the disk, wherein the griping means is mounted on the gripper bar;

means for connecting the gripper bar to the disk and permitting the gripper bar to pivot relative to the disk; and a cam over which the disk is mounted, wherein the cam has an edge which engages and directs the movement of the gripper bar, wherein as the disk cyclically rotates back and forth around its center, the gripper bar changes position due to its changing engagement with the edge of the cam.

9. The apparatus of claim 8 wherein the disk has a pie-shaped cutout portion which engages the gripper bar to direct the gripper bar and the gripping means to deliver the first sheet to the second location after a predetermined number of cycles of gripping means motion.

10. A method for breaking the adhesion between first and second sheets of material when sheets are to be transported one at a time from a stack in a first location to a second location, wherein each sheet has a leading edge, the method comprising:

gripping the first sheet on the stack from its side opposite the second sheet;

transporting the first sheet from the first location to the second location; and repeatedly and cyclically moving the leading edge of the first sheet while transporting the first sheet, wherein the repeated cyclical moving comprises alternately moving the leading edge from the first location toward the second location, moving the leading edge from the second location toward the first location, and then again moving the leading edge from the first location toward the second location.

11. The method of claim 10 wherein the moving step comprises causing air pockets to travel between the first and second sheets to break the adhesion while maintaining the leading edge of the first sheet substantially parallel to the sheet stack.

12. The method of claim 11 wherein the step of causing air pockets to travel between the first and second sheets to break the adhesion comprises moving the leading edge of the first sheet in a nonlinear motion having both vertical and horizontal components, wherein the vertical component of the nonlinear motion traps the air and the horizontal component of the nonlinear motion transports the air.

13. The method of claim 10 wherein the moving step comprises translating the first sheet relative to the second sheet to break the adhesion.

14. The method of claim 13 wherein the step of translating the first sheet in the plane of the first sheet and relative to the second sheet to break the adhesion comprises moving the leading edge of the first sheet in a nonlinear motion having both vertical and horizontal components, wherein the horizontal component of the nonlinear motion translates the first sheet.

15. The method of claim 10 wherein the moving step comprises:

moving the leading edge of the first sheet from a first position to a second position;

moving the leading edge of the first sheet from the second position back toward the first position and to a third position located between the second position and the first position;

moving the leading edge of the first sheet from the third position toward and past the second position and to a fourth position;

moving the leading edge of the first sheet from the fourth position toward the third position and to a fifth position;

moving the leading edge of the first sheet from the fifth position toward the fourth position and to a sixth position; and moving the leading edge of the first sheet from the sixth position toward the fifth position and to a seventh position.

16. The method of claim 15 wherein during the movement of the leading edge of the first sheet between positions, the leading edge is displaced in both the vertical and horizontal directions.

17. An apparatus for transporting sheets of material one at a time from a stack in a first location to a second location and for breaking the adhesion between the first and second sheets on the stack to prevent the transportation of more than one sheet at a time, wherein each sheet has a leading edge, the apparatus comprising:

means for gripping the first sheet on the stack from its side opposite the second sheet;

means for transporting the first sheet from the first location to the second location; and means for repeatedly and cyclically moving the leading edge of the first sheet while the transporting means moves the first sheet, wherein the cyclical movement has components moving the leading edge from the first location toward the second location and components moving the leading edge from the second location toward the first location, wherein the transporting means and the moving means are a single integral system comprising:

two pivoting bars which are connected in parallel at respective fixed points and which pivot around their fixed points while remaining parallel to each other;

a link which connects the respective free ends of the pivoting bars; and a gripper bar which extends from the link, wherein the griping means is mounted on the gripper bar and wherein as the pivoting bars cyclically pivot back and forth, the gripper bar changes position.

18. The apparatus of claim 17 wherein the pivoting bars pivot to direct the gripper bar and the gripping means to deliver the first sheet to the second location after a predetermined number of cycles of gripping means motion.

* * * * *